US011345377B2

(12) United States Patent
Kernwein

(10) Patent No.: US 11,345,377 B2
(45) Date of Patent: May 31, 2022

(54) VEHICLE MOTION SENSING SYSTEM

(71) Applicant: Westinghouse Air Brake Technologies Corporation, Wilmerding, PA (US)

(72) Inventor: Jeffrey D. Kernwein, Cedar Rapids, IA (US)

(73) Assignee: WESTINGHOUSE AIR BRAKE TECHNOLOGIES CORPORATION, Wilmerding, PA (US)

( * ) Notice: Subject to any disclaimer, the term of this patent is extended or adjusted under 35 U.S.C. 154(b) by 762 days.

(21) Appl. No.: 16/235,243

(22) Filed: Dec. 28, 2018

(65) Prior Publication Data

US 2020/0207385 A1 Jul. 2, 2020

(51) Int. Cl.
*B61L 3/00* (2006.01)
*B61L 15/00* (2006.01)

(52) U.S. Cl.
CPC ..... *B61L 3/008* (2013.01); *B61L 15/0018* (2013.01); *B61L 15/0054* (2013.01); *B61L 15/0072* (2013.01)

(58) Field of Classification Search
CPC .. B61L 3/008; B61L 15/0018; B61L 15/0054; B61L 15/0072
See application file for complete search history.

(56) References Cited

U.S. PATENT DOCUMENTS

| | | | | |
|---|---|---|---|---|
| 11,148,692 | B2 * | 10/2021 | Bramucci | B61L 3/125 |
| 2012/0166109 | A1 * | 6/2012 | Kernwein | B61L 15/0036 702/47 |
| 2016/0355199 | A1 * | 12/2016 | Kernwein | B61L 1/02 |
| 2017/0355388 | A1 * | 12/2017 | Schultz | B61L 29/32 |
| 2019/0196026 | A1 * | 6/2019 | Craven | G01S 19/071 |
| 2019/0225247 | A1 * | 7/2019 | Garmson | B61L 15/0072 |
| 2020/0122757 | A1 * | 4/2020 | Abrosimov | B61L 15/0072 |
| 2020/0207385 | A1 * | 7/2020 | Kernwein | B61L 15/0027 |
| 2021/0039692 | A1 * | 2/2021 | Craven | G01S 19/43 |
| 2021/0134081 | A1 * | 5/2021 | Claussen | B61L 1/10 |

* cited by examiner

*Primary Examiner* — Jason C Smith
(74) *Attorney, Agent, or Firm* — Will Breeze; The Small Patent Law Group LLC

(57) ABSTRACT

A device for attachment to a train having a lead locomotive or control car and a rear car in a track network having a plurality of tracks is disclosed. The device may include at least one sensor. The sensor(s) may be disposed with the rear car. The sensor(s) may be configured to generate sensor data associated with at least one of a heading of the rear car of the train or a distance between the rear car of the train and an object in the track network. A communication interface may be configured to transmit the sensor data to at least one receiver. The receiver(s) may provide at least one indication based on the sensor data. A device for use onboard the train, a control system, a method for operating the device(s), and a method for coupling the train to a separate car are also disclosed.

20 Claims, 4 Drawing Sheets

VEHICLE MOTION SENSING SYSTEM

BACKGROUND

1. Field

This disclosure relates generally to systems, devices, products, apparatuses, and methods that are used for sensing and indicating motion of a rear car of a train and, in some particular embodiments, to a system, product, and method for sensing and indicating motion of a rear car of a train relative to an object in a track network.

2. Technical Considerations

Certain rail vehicles (e.g., trains, locomotives, railroad cars, passenger cars, coaches, freight cars, wagons, and/or the like) may include a lead locomotive, a control car, and/or some other compartment at a front of the rail vehicle for an operator (e.g., engineer, driver, and/or the like) to control and/or drive the rail vehicle. Such an operator may have relatively good visibility (e.g., field of view, line of sight, and/or the like) of what is in front of the rail vehicle and/or around the front of the rail vehicle. However, the operator may have relatively poor visibility or even no visibility of what is behind the rail vehicle and/or around the rear of the rail vehicle. As such, it may be difficult for an operator to operate (e.g., drive, move, and/or the like) the rail vehicle in reverse and/or to move the rail vehicle into position for coupling with an object (e.g., another rail vehicle) in the track network.

Certain rail vehicles may have at least one crew member in addition to the operator. For example, such a crew member may be positioned at or near the rear of the rail vehicle while the rail vehicle is operating in reverse (e.g., moving towards an object in the track network.) Additionally, the crew member may provide indications (e.g., verbal indications, visual indications such as hand signals, and/or the like) to the operator of the train while the operator is operating the train in reverse. However, it may be undesirable to have multiple crew members and/or crew members whose responsibilities are only required occasionally during operation of the rail vehicle (e.g., a crew member solely for attending to the rear of the rail vehicle while traveling).

SUMMARY

Accordingly, systems, devices, products, apparatuses, and/or methods for sensing and indicating motion of a rear car (e.g., relative to an object in a track network) are disclosed that overcome some or all of the aforementioned deficiencies.

According to non-limiting embodiments, provided is a device for attachment to a train having a lead locomotive or control car and a rear car in a track network having a plurality of tracks. The device may include at least one sensor disposed with the rear car. The sensor(s) may be configured to generate sensor data associated with at least one of a heading of the rear car of the train or a distance between the rear car of the train and an object in the track network. A communication interface may be configured to transmit the sensor data to at least one receiver. The receiver (s) may provide at least one indication based on the sensor data.

In some non-limiting embodiments, the sensor(s) and the communication interface may be disposed with the rear car. Additionally or alternatively, the sensor(s) and the communication interface may be integrated with an end of train (EOT) device coupled to a trailing coupler of the rear car. Additionally or alternatively, the sensor(s) may be removably connected to the EOT device.

In some non-limiting embodiments, the receiver(s) may include an operator interface onboard the lead locomotive or control car. Additionally or alternatively, the operator interface may be integrated with at least one of a head of train (HOT) device, a positive train control (PTC), or an electronic train management system (ETMS).

In some non-limiting embodiments, the receiver(s) may include a remote server.

In some non-limiting embodiments, the sensor(s) may include a first sensor configured to sense the heading of the rear car of the train and a second sensor to sense the distance between the rear car of the train and the object in the track network. Additionally or alternatively, the indication(s) may include at least one of an audible indication or a visual indication.

In some non-limiting embodiments, the receiver(s) may be configured to automatically control a velocity of the train based on the sensor data.

According to non-limiting embodiments, provided is a device for use onboard a train having a lead locomotive or control car and a rear car in a track network having a plurality of tracks. The device may include a communication interface, which may be configured to receive sensor data from at least one sensor disposed with the rear car. The sensor data may be associated with at least one of a heading of the rear car of the train or a distance between the rear car of the train and an object in the track network. An operator interface may be configured to provide at least one indication based on the sensor data.

In some non-limiting embodiments, the device may be the same as or similar to a receiver, as described herein. Additionally or alternatively, the device may be an operator interface, as described herein.

According to non-limiting embodiments, provided is a control system for a train having a lead locomotive or control car and a rear car in a track network having a plurality of tracks. The control system may include a device for attachment to the train. The device may include at least one sensor disposed with the rear car and a communication interface. The sensor(s) may be configured to generate sensor data associated with at least one of a heading of the rear car of the train or a distance between the rear car of the train and an object in the track network. The communication interface may be configured to transmit the sensor data. An operator interface may be onboard the lead locomotive or control car. The operator interface may be configured to receive sensor data from the communication interface. The operator interface may further be configured to provide at least one indication based on the sensor data.

In some non-limiting embodiments, the communication interface may be integrated with an EOT device coupled to a trailing coupler of the rear car. Additionally or alternatively, wherein the sensor(s) may be removably connected to the EOT device.

In some non-limiting embodiments, the operator interface may be integrated with at least one of an HOT device, a PTC, or an ETMS.

In some non-limiting embodiments, a remote server may be configured to receive at least one of the sensor data from the communication interface or the indication from the operator interface.

In some non-limiting embodiments, the operator interface may be configured to automatically control a velocity of the train based on the sensor data.

According to non-limiting embodiments, provided is a method for operating a device attached to a train having a lead locomotive or control car and a rear car in a track network having a plurality of tracks. The method may include sensing, with at least one sensor disposed with the rear car, at least one of a heading of the rear car of the train or a distance between the rear car of the train and an object in the track network. Sensor data may be generated based on the heading of the rear car of the train and/or the distance between the rear car of the train and the object in the track network. The sensor data may be communicated. At least one indication may be provided based on the sensor data.

In some non-limiting embodiments, an operator interface may be disposed onboard the lead locomotive or control car. Additionally or alternatively, the sensor data may be communicated to the operator interface. Additionally or alternatively, the indication(s) may be provided by the operator interface based on the sensor data. In some non-limiting embodiments, the operator interface may be integrated with at least one of an HOT device, a PTC, or an ETMS. Additionally or alternatively, the operator interface may include a display screen. Additionally or alternatively, the indication(s) may be provided by the operator interface displaying at least one visual indication on the display screen.

In some non-limiting embodiments, a velocity of the train may be automatically controlled based on the sensor data.

In some non-limiting embodiments, the object may include at least one separate car (e.g., an uncoupled car, a cut of cars, and/or the like). Additionally or alternatively, the train may be moved towards the separate car in the track network. Additionally or alternatively, the sensing, generating, communicating, and providing may be repeated as the train moves towards the separate car in the track network.

According to non-limiting embodiments, provided is a method for coupling a train having a lead locomotive or control car and a rear car to a separate car in a track network having a plurality of tracks. The method may include moving the train towards the separate car in the track network. At least one sensor may be disposed with the rear car of the train. The sensor(s) may sense at least one of a heading of the rear car of the train or a distance between the rear car of the train and the separate car in the track network. Sensor data may be generated based on the heading of the rear car of the train and/or the distance between the rear car of the train and the separate car in the track network. The sensor data may be communicated to an operator interface onboard the lead locomotive or the control car. The operator interface may provide an indication based on the sensor data.

Further embodiments or aspects are set forth in the following numbered clauses:

Clause 1: A device for attachment to a train having a lead locomotive or control car and a rear car in a track network having a plurality of tracks, comprising: at least one sensor disposed with the rear car, the at least one sensor configured to generate sensor data associated with at least one of a heading of the rear car of the train or a distance between the rear car of the train and an object in the track network; and a communication interface configured to transmit the sensor data to at least one receiver, wherein the at least one receiver provides at least one indication based on the sensor data.

Clause 2: The device of clause 1, wherein the at least one sensor and the communication interface are disposed with the rear car.

Clause 3: The device of one of clauses 1 or 2, wherein the at least one sensor and the communication interface are integrated with an end of train (EOT) device coupled to a trailing coupler of the rear car.

Clause 4: The device of any one of the preceding clauses, wherein the at least one sensor is removably connected to an EOT device.

Clause 5: The device of any one of the preceding clauses, wherein the at least one receiver comprises an operator interface onboard the lead locomotive or control car.

Clause 6: The device of any one of the preceding clauses, wherein the operator interface is integrated with at least one of a head of train (HOT) device, a positive train control (PTC), or an electronic train management system (ETMS).

Clause 7: The device of any one of the preceding clauses, wherein the at least one receiver is a remote server.

Clause 8: The device of any one of the preceding clauses, wherein the at least one sensor comprises a first sensor configured to sense the heading of the rear car of the train and a second sensor to sense the distance between the rear car of the train and the object in the track network.

Clause 9: The device of any one of the preceding clauses, wherein the at least one indication comprises at least one of an audible indication or a visual indication.

Clause 10: The device of any one of the preceding clauses, wherein the at least one receiver is configured to automatically control a velocity of the train based on the sensor data.

Clause 11: A device for use onboard a train having a lead locomotive or control car and a rear car in a track network having a plurality of tracks, comprising: a communication interface configured to receive sensor data from at least one sensor disposed with the rear car, wherein the sensor data is associated with at least one of a heading of the rear car of the train or a distance between the rear car of the train and an object in the track network; an operator interface configured to provide at least one indication based on the sensor data.

Clause 12: The device of clause 11, wherein the communication interface and the operator interface are disposed with the lead locomotive or control car.

Clause 13: The device of one of clauses 11 or 12, wherein the at least one sensor is integrated with an end of train (EOT) device coupled to a trailing coupler of the rear car.

Clause 14: The device of any one of clauses 11-13, wherein the at least one sensor is removably connected to an EOT device.

Clause 15: The device of any one of clauses 11-14, wherein the operator interface is onboard the lead locomotive or control car.

Clause 16: The device of any one of clauses 11-15, wherein the operator interface is integrated with at least one of a head of train (HOT) device, a positive train control (PTC), or an electronic train management system (ETMS).

Clause 17: The device of any one of clauses 11-16, wherein the communication interface is configured to communicate with at least one remote server.

Clause 18: The device of any one of clauses 11-17, wherein the at least one sensor comprises a first sensor configured to sense the heading of the rear car of the train and a second sensor to sense the distance between the rear car of the train and the object in the track network.

Clause 19: The device of any one of clauses 11-18, wherein the at least one indication comprises at least one of an audible indication or a visual indication.

Clause 20: The device of any one of clauses 11-19, wherein the operator interface is configured to automatically control a velocity of the train based on the sensor data.

Clause 21: A control system for a train having a lead locomotive or control car and a rear car in a track network having a plurality of tracks, comprising: a device for attachment to the train, the device comprising: at least one sensor disposed with the rear car, the at least one sensor configured to generate sensor data associated with at least one of a heading of the rear car of the train or a distance between the rear car of the train and an object in the track network; and a communication interface configured to transmit the sensor data; and an operator interface onboard the lead locomotive or control car and configured to receive sensor data from the communication interface, wherein the operator interface is configured to provide at least one indication based on the sensor data.

Clause 22: The control system of clause 21, wherein the communication interface is integrated with an end of train (EOT) device coupled to a trailing coupler of the rear car, and wherein the at least one sensor is removably connected to the EOT device.

Clause 23: The control system of one of clauses 21 or 22, wherein the operator interface is integrated with at least one of a head of train (HOT) device, a positive train control (PTC), or an electronic train management system (ETMS).

Clause 24: The control system of any one of clauses 21-23, further comprising a remote server configured to receive at least one of the sensor data from the communication interface or the indication from the operator interface.

Clause 25: The control system of any one of clauses 21-24, wherein the operator interface is configured to automatically control a velocity of the train based on the sensor data.

Clause 26: A method for operating a device attached to a train having a lead locomotive or control car and a rear car in a track network having a plurality of tracks, comprising: sensing, with at least one sensor disposed with the rear car, at least one of a heading of the rear car of the train or a distance between the rear car of the train and an object in the track network; generating sensor data based on the at least one of the heading of the rear car of the train and the distance between the rear car of the train and the object in the track network; communicating the sensor data; and providing at least one indication based on the sensor data.

Clause 27: The method of clause 26, wherein an operator interface is disposed onboard the lead locomotive or control car, wherein communicating comprises communicating the sensor data to the operator interface, and wherein providing comprises providing, by the operator interface, the at least one indication based on the sensor data.

Clause 28: The method of one of clauses 26 or 27, wherein the operator interface is integrated with at least one of a head of train (HOT) device, a positive train control (PTC), or an electronic train management system (ETMS), wherein the operator interface comprises a display screen, and wherein providing the at least one indication comprises displaying at least one visual indication on the display screen.

Clause 29: The method of any one of clauses 26-28, further comprising automatically controlling a velocity of the train based on the sensor data.

Clause 30: The method of any one of clauses 26-29, wherein the object comprises a separate car, the method further comprising: moving the train towards the separate car in the track network; and repeating the sensing, generating, communicating, and providing as the train moves towards the separate car in the track network.

Clause 31: A method for coupling a train having a lead locomotive or control car and a rear car to a separate car in a track network having a plurality of tracks, comprising: moving the train towards the separate car in the track network; sensing, with at least one sensor disposed with the rear car of the train, at least one of a heading of the rear car of the train or a distance between the rear car of the train and the separate car in the track network; generating sensor data based on the at least one of the heading of the rear car of the train and the distance between the rear car of the train and the separate car in the track network; communicating the sensor data to an operator interface onboard the lead locomotive or the control car; and providing, with the operator interface, an indication based on the sensor data.

Clause 32: The method of clause 31, wherein the operator interface is integrated with at least one of a head of train (HOT) device, a positive train control (PTC), or an electronic train management system (ETMS), wherein the operator interface comprises a display screen, and wherein providing the at least one indication comprises displaying at least one visual indication on the display screen.

Clause 33: The method of one of clauses 31 or 32, further comprising automatically controlling a velocity of the train based on the sensor data.

Clause 34: The method of any one of clauses 31-33, further comprising: repeating the sensing, generating, communicating, and providing as the train moves towards the separate car in the track network.

Clause 35: The method of any one of clauses 31-34, further comprising: stopping the train based on the sensor data; and coupling the train to the separate car in the track network.

BRIEF DESCRIPTION OF THE DRAWINGS

Additional advantages and details of the disclosed subject matter are explained in greater detail below with reference to the exemplary embodiments that are illustrated in the accompanying schematic figures, in which.

DETAILED DESCRIPTION

Figure 1:
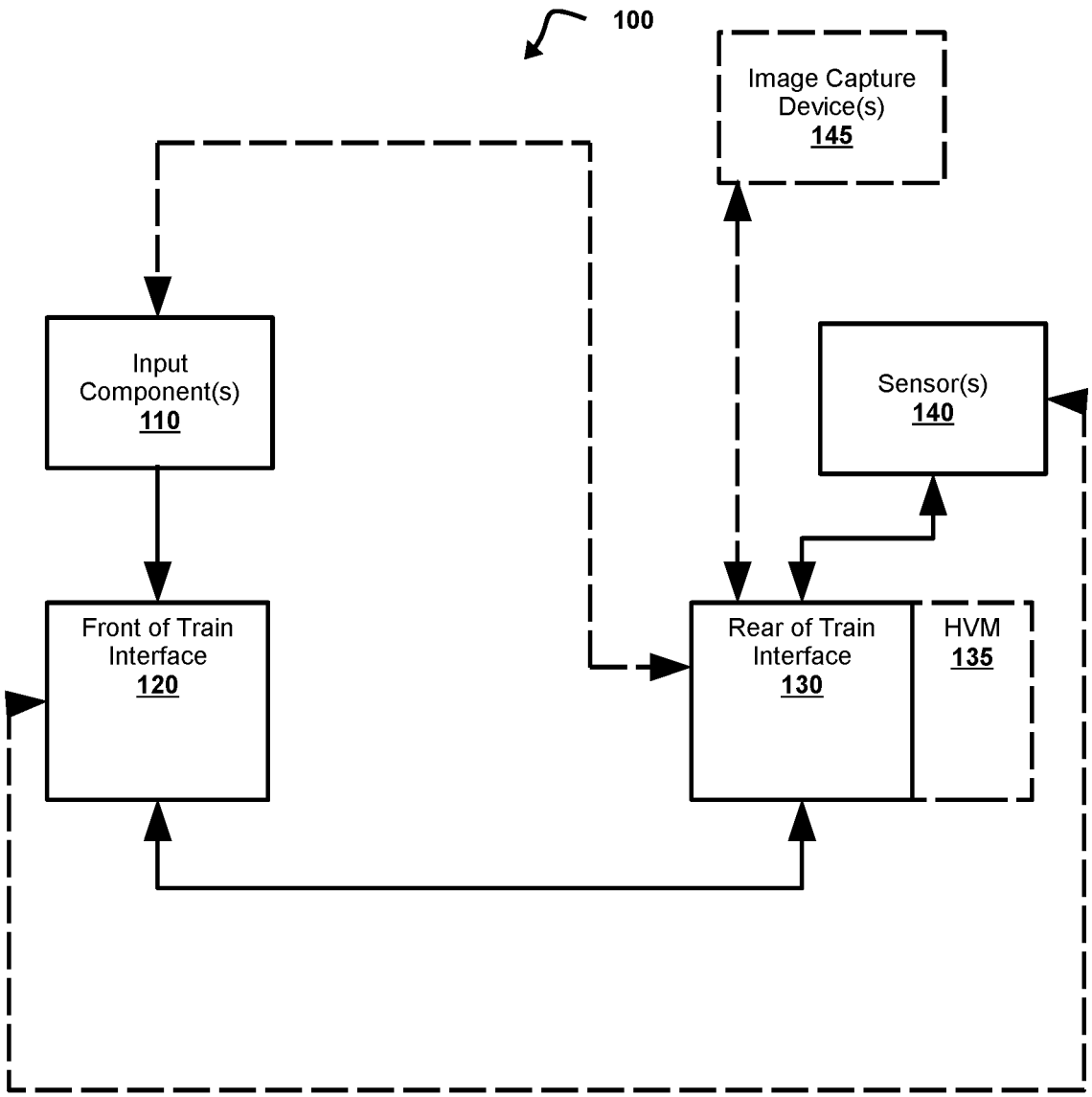
FIG. 1 is a diagram of a non-limiting embodiment of an environment in which systems, devices, products, apparatuses, and/or methods, described herein, may be implemented according to the principles of the presently disclosed subject matter.

The following detailed description of non-limiting embodiments refers to the accompanying drawings. The same reference numbers in different drawings may identify the same or similar elements.

For purposes of the description hereinafter, the terms "end," "upper," "lower," "right," "left," "vertical," "horizontal," "top," "bottom," "lateral," "longitudinal," and derivatives thereof shall relate to the disclose subject matter as it is oriented in the drawing figures. However, it is to be understood that the disclosed subject matter may assume various alternative variations and step sequences, except where expressly specified to the contrary. It is also to be understood that the specific devices and processes illustrated in the attached drawings, and described in the following specification, are simply exemplary embodiments or aspects of the disclosed subject matter. Hence, specific dimensions and other physical characteristics related to the embodiments or aspects of the embodiments disclosed herein are not to be considered as limiting unless otherwise indicated.

No aspect, component, element, structure, act, step, function, instruction, and/or the like used herein should be construed as critical or essential unless explicitly described as such. Also, as used herein, the articles "a" and "an" are intended to include one or more items, and may be used interchangeably with "one or more" and "at least one." Furthermore, as used herein, the term "set" is intended to include one or more items (e.g., related items, unrelated items, a combination of related and unrelated items, etc.) and may be used interchangeably with "one or more" or "at least one." Where only one item is intended, the term "one" or similar language is used. Also, as used herein, the terms "has," "have," "having," or the like are intended to be open-ended terms. Further, the phrase "based on" is intended to mean "based at least partially on" unless explicitly stated otherwise.

As used herein, the terms "communication" and "communicate" may refer to the reception, receipt, transmission, transfer, provision, and/or the like of information (e.g., data, signals, messages, instructions, commands, and/or the like). For one unit (e.g., a device, a system, a component of a device or system, combinations thereof, and/or the like) to be in communication with another unit means that the one unit is able to directly or indirectly receive information from and/or transmit information to the other unit. This may refer to a direct or indirect connection that is wired and/or wireless in nature. Additionally, two units may be in communication with each other even though the information transmitted may be modified, processed, relayed, and/or routed between the first and second unit. For example, a first unit may be in communication with a second unit even though the first unit passively receives information and does not actively transmit information to the second unit. As another example, a first unit may be in communication with a second unit if at least one intermediary unit (e.g., a third unit located between the first unit and the second unit) processes information received from the first unit and communicates the processed information to the second unit. In some non-limiting embodiments, a message may refer to a network packet (e.g., a data packet and/or the like) that includes data. It will be appreciated that numerous other arrangements are possible. It will be appreciated that numerous other arrangements are possible.

Non-limiting embodiments of the disclosed subject matter are directed to systems, devices, products, apparatuses, and/or methods for sensing and indicating motion of a rear car of a train, including, but not limited to, sensing and indicating motion of a rear car of a train relative to an object in a track network (e.g., a plurality of interconnected tracks). For example, non-limiting embodiments of the disclosed subject matter provide an indication (e.g., visual indication, audible indication, and/or the like) to an operator and/or a system controlling a rail vehicle based on at least one of a heading of the rear car of the train or a distance between the rear car of the train and an object in the track network. Such embodiments provide techniques and systems for indicating the distance, closing speed/velocity, and/or the like of an object (e.g., a separate car or group of cars and/or the like) from the rear of the train while the train is moving in reverse. As such, the operator and/or system controlling the rail vehicle may be better able to manage the velocity of the train and/or the like while the train is moving in reverse (e.g., to couple the rail vehicle with the separate car(s) in the track network). Additionally or alternatively, such embodiments provide techniques and systems for indicating the heading of the rear car (e.g., direction of the rear car, a sudden change in the direction, and/or the like), which may be useful where the train is intended to move through a switch (e.g., siding switch) and/or onto a different track in the track network. For example, if one or more separate car(s) are on a different track near the switch, the rear car of the rail vehicle may move through the switch before the lead locomotive/control car, so it may be beneficial to the operator to be provided with an indication that the rear car has changed heading as a result of moving through the switch onto the different track. Additionally or alternatively, such embodiments provide techniques and systems that obviate the need for a crew member to be positioned at or near the rear of the rail vehicle while the rail vehicle is operating in reverse, thus reducing the size of the crew necessary to safely and effectively move the rail vehicle in reverse.

Referring now to FIG. 1, FIG. 1 is a diagram of a non-limiting embodiment of an environment 100 in which systems, devices, products, apparatuses, and/or methods, described herein, may be implemented. As shown in FIG. 1, environment 100 may include at least one input component 110; (front of train) interface 120; (rear of train) interface 130; high visibility marker (HVM) 135; at least one sensor 140; and/or at least one image capture device 145. Systems and/or devices of environment 100 may interconnect via wired connections, wireless connections, or a combination of wired and wireless connections. For example, systems and/or devices of environment 100 may interconnect via one or more wired and/or wireless networks, where the one or more wired and/or wireless networks may include a cellular network (e.g., a long-term evolution (LTE) network, a third generation (3G) network, a fourth generation (4G) network, a code division multiple access (CDMA) network, etc.), a public land mobile network (PLMN), a local area network (LAN), a wide area network (WAN), a metropolitan area network (MAN), a telephone network (e.g., the public switched telephone network (PSTN)), a private network, an ad hoc network, an intranet, the Internet, a fiber optic-based network, a cloud computing network, an Association of American Railroads (AAR) wireless communication system (e.g., AAR Wireless Communications Committee (WCC) standard and/or the like), and/or the like, and/or a combination of these or other types of networks.

As shown in FIG. 1, in some non-limiting embodiments, at least one sensor 140 may be disposed with a rail vehicle. For example, the rail vehicle may be a train having at least one car. In some non-limiting embodiments, the sensor(s) 140 may be disposed with a rear car of the train. In some non-limiting embodiments, the sensor(s) 140 may include a heading sensor configured to sense the heading of the rail vehicle (e.g., the heading of the rear car with which the heading sensor is disposed). Additionally or alternatively, the sensor(s) 140 may include a distance sensor to sense the distance between the rail vehicle (e.g., the rear car with which the distance sensor is disposed) and at least one object in the track network (e.g., a plurality of interconnected tracks, at least some of which may be interconnected).

In some non-limiting embodiments, sensor(s) 140 may include at least one of radar, LIDAR, ultrasonic ranging, and/or the like to sense and/or determine the distance between the rail vehicle (e.g., the rear car with which sensor(s) 140 is/are disposed) and at least one object in the track network. Additionally or alternatively, sensor(s) 140 may include image capture device(s) 145, such as a camera, a set of multi-view/three-dimensional cameras, and/or the like. For example, image processing may be used to determine the distance between the rail vehicle and at least one object based on image processing and/or the like.

In some non-limiting embodiments, sensor(s) 140 may include at least one of an accelerometer, a magnetometer/compass, a positioning system (e.g., global positioning system (GPS)), and/or the like to determine the heading of the rail vehicle (e.g., the heading of the rear car with which sensor(s) 140 is/are disposed). For example, an accelerometer may be used to determine a change in heading, e.g., based on sensed acceleration. Additionally or alternatively, a magnetometer/compass and/or position system may be used to determine the heading in degrees (e.g., relative to meridian lines, relative to north, and/or the like), a cardinal direction (e.g., north (N), south (S), east (E), west (W), and/or the like), an intercardinal direction (e.g., northeast (NE), northwest (NW), southeast (SE), southwest (SW) and/or the like), a secondary intercardinal direction (e.g., north-northeast (NNE), east-northeast (ENE), east-southeast (ESE), south-southeast (SSE), south-southwest (SSW) west-southwest (WSW), west-northwest (WNW), north-northwest (NNW), and/or the like), or an intermediate direction between cardinal, intercardinal, and secondary intercardinal directions (e.g., north by east (NbE), northeast by north (NEbN), northeast by east (NEbE), east by north (EbN), etc., and/or the like), and/or the like.

In some non-limiting embodiments, the sensor(s) 140 may generate sensor data associated with the property being sensed. For example, a distance sensor may generate sensor data (e.g., distance data) associated with the distance between the rail vehicle (e.g., the rear car with which the distance sensor is disposed) and an object in the track network. Additionally or alternatively, a heading sensor may generate sensor data (e.g., heading data) associated with the heading of the rail vehicle (e.g., the heading of the rear car with which the heading sensor is disposed).

In some non-limiting embodiments, the sensor data may include at least one digital signal, e.g., associated with the property being sensed. For example, a digital signal may include at least one of a message (e.g., packet, frame, and/or the like of data, information, and/or the like), a code word, a bit, a sequence of bits, a bit stream, and/or the like. Additionally or alternatively, the control signal(s) may include an analog signal (e.g., an electrical signal, an electromagnetic signal, and/or the like), e.g., associated with the property being sensed. In some non-limiting embodiments, the control signal(s) may include an interruption in a digital or analog signal (e.g., a temporary or permanent disconnection, a modulation, and/or the like).

In some non-limiting embodiments, the object(s) in the track network may include a separate car, a group of cars (e.g., a cut of cars coupled to each other but not yet coupled to the rail vehicle, and/or the like), and/or the like. In some non-limiting embodiments, the rail vehicle may be moved in reverse (e.g., in response to input by the operator, a control system, and/or the like) towards the object(s) (e.g., separate car and/or the like). For example, the rail vehicle may be moved in reverse toward the object(s) (e.g., separate car and/or the like) in order to position the rail vehicle sufficiently close to the object(s) to couple the object(s) to the rail vehicle (e.g., a trailing coupler of the rear car of the rail vehicle).

In some non-limiting embodiments, interface 120 may be located at a first location (e.g., at a front of a rail vehicle, such as a lead locomotive or control car and/or the like). Additionally or alternatively, interface 130 may be located at a second location (e.g., at a rear of a rail vehicle, such as a rear car and/or the like) that is different than the first location. For example, interface 120 may be located within an operator compartment of a rail vehicle (e.g., at the front of the rail vehicle). Additionally or alternatively, interface 130 may be mounted on a different rail vehicle (e.g., a rear car of the rail vehicle and/or the like). In some non-limiting embodiments, interface 120 may be mounted on a rail vehicle and interface 130 may be mounted on the same rail vehicle. For example, interface 120 may be located in an operator compartment of a lead locomotive or control car and interface 130 may be on a trailing coupler of such lead locomotive or control car.

In some non-limiting embodiments, sensor(s) 140 may be integrated with and/or coupled to interface 130. Additionally or alternatively, interface 130 may include an end of train (EOT) device. In some non-limiting embodiments, interface 130 (e.g., EOT device) may be coupled to a trailing coupler of the rear car of a train. In some non-limiting embodiments, sensor(s) 140 may be separate from and/or external to interface 130. In some non-limiting embodiments, sensor(s) 140 may be disposed proximate to a trailing end of the rear car. In some non-limiting embodiments, sensor(s) 140 may be removably connected to interface 130 (e.g., EOT device).

In some non-limiting embodiments, interface 130 may include a communication interface. For example, interface 130 (e.g., the communication interface) may be configured to transmit the sensor data from sensor(s) 140 to at least one receiver (e.g., interface 120, an operator interface at a front of the rail vehicle, a remote server, and/or the like). In some non-limiting embodiments, the receiver (e.g., interface 120, an operator interface at a front of the rail vehicle, a remote server, and/or the like) may provide at least one indication based on the sensor data, as described herein. In some non-limiting embodiments, the communication interface may include any suitable number of interfaces for wired or wireless communication, e.g., an Ethernet interface, an optical interface, a coaxial interface, an infrared interface, a radio frequency (RF) interface, a universal serial bus (USB) interface, a Wi-Fi interface, a cellular network interface (e.g., a long-term evolution (LTE) network, a third generation (3G) network, a fourth generation (4G) network, a code division multiple access (CDMA) network, etc.), a public land mobile network (PLMN), a local area network (LAN), a wide area network (WAN), a metropolitan area network (MAN), a telephone network (e.g., the public switched telephone network (PSTN)), a private network, an ad hoc network, an intranet, the Internet, a fiber optic-based network, a cloud computing network, an Association of American Railroads (AAR) wireless communication system (e.g., AAR Wireless Communications Committee (WCC) standard and/or the like).

In some non-limiting embodiments, the HVM 135 may be integrated with and/or coupled to interface 130 (e.g., EOT device). In some non-limiting embodiments, HVM 135 may include a visual indicator (e.g., a light source and/or the like). In some non-limiting embodiments, HVM 135 may be disposed proximate to a trailing end of the rear car. Additionally or alternatively, HVM 135 may be removably connected to interface 130 (e.g., EOT device).

In some non-limiting embodiments, interface 120 may include an operator interface. Additionally or alternatively, interface 120 (e.g., operator interface) may be onboard an operator compartment of a rail vehicle (e.g., at the front of the rail vehicle, such as in a lead locomotive, a control car, and/or the like). In some non-limiting embodiments, interface 120 may include (e.g., be integrated with, coupled to, and/or the like) at least one of a head of train (HOT) device, a positive train control (PTC) device, or an electronic train management system (ETMS) device.

In some non-limiting embodiments, interface 120 may include (e.g., completely, partially, and/or the like) a remote server (e.g., PTC server, ETMS server, and/or the like), a remote control system for the rail vehicle, and/or the like.

In some non-limiting embodiments, interface 120 may receive sensor data (e.g., from sensor(s) 140 and/or interface 130). Additionally or alternatively, interface 120 may provide an indication based on the sensor data. In some non-limiting embodiments, interface 120 (e.g., an operator interface, HOT device, and/or the like) may include a display screen. Additionally or alternatively, the display screen may provide a visual indication based on the sensor data. For example, when sensor data includes heading data, the display screen may display an indication of the heading of at least part of the rail vehicle (e.g., a rear train of the rail vehicle). In some non-limiting embodiments, the indication of the heading may include displaying the heading in degrees, cardinal direction, intercardinal direction, secondary intercardinal direction, other intermediate direction, and/or the like. In some non-limiting embodiments, when sensor data includes distance data, the display screen may display an indication of distance. For example, the indication of distance may be in any suitable numerical units (e.g., a number of feet, inches, meters, and/or the like). In some non-limiting embodiments, the indication may be a graphical indication, e.g., a position on a line, a position in a two-dimensional image, and/or the like. In some non-limiting embodiments, the indication of heading and/or distance may be displayed overlaid on an image, video, and/or the like captured from one or more image capture device(s) 145 (e.g., camera(s) and/or the like). For example, such image capture device(s) 145 may be disposed with a rear of the rail vehicle (e.g., a rear car of the rail vehicle) and/or may have a field of view proximate to the rear of the rail vehicle.

In some non-limiting embodiments, interface 120 may include one or more lights associated with the heading of at least a portion of the rail vehicle (e.g., the rear car). For example, when sensor data includes heading data, a single light may activate (e.g., turn on, change color, and/or the like) after a change in heading. In some non-limiting embodiments, interface 120 may determine whether there is a change in heading based on the sensor data changing a certain amount (e.g., a certain number of degrees and/or the like). Additionally or alternatively, interface 120 may determine whether there is a change in heading based on the sensor data associated with a force, an acceleration, a change in velocity, and/or the like. In some non-limiting embodiments, interface 120 may include lights for each cardinal direction, each intercardinal direction, and/or the like, and the respective light may be activated (e.g., turn on, change color, and/or the like) based on sensor data associated with the direction associated with the respective light.

In some non-limiting embodiments, interface 120 may include one or more lights associated with the distance between the rear car of the train and an object in the track network. For example, when sensor data includes heading data, a single light may activate (e.g., turn on, change color, and/or the like) after distance becoming below a certain threshold. Additionally or alternatively, the single light may have a pattern of activations (e.g., blink on or off at certain periods) based on distance becoming below one or more thresholds. Additionally or alternatively, the single light may have a pattern (e.g., blink on and off) that includes a period that is adjusted based on the distance (e.g., shorter periods as the distance decreases). Additionally or alternatively, the single light may activate different colors based on the distance becoming below one or more thresholds (e.g., green within a first distance, yellow within a second distance less than the first distance, red within a third distance less than a second distance).

In some non-limiting embodiments, interface 120 may include an audio device (e.g., a speaker, a bell, and/or the like) to provide an audible indication (e.g., a noise, a tone, a chime, and/or the like). For example, when sensor data includes heading data, an audible indication may be provided after a change in heading. Additionally or alternatively, the audible indication may include a verbal indication of the heading (e.g., using text-to-speech (TTS) to convert a cardinal direction, intercardinal direction, and/or the like into an audible indication). In some non-limiting embodiments, when sensor data includes distance data, an audible indication may be provided when distance becomes lower than at least one threshold. Additionally or alternatively, a pattern of audible indication may include a period that is adjusted based on the distance (e.g., shorter periods as the distance decreases, resulting in progressively more rapid repetition of sounds/audible indications based on distance. Additionally or alternatively, the audible indication may include a verbal indication of the distance (e.g., using text-to-speech (TTS) to convert a numerical distance into an audible indication).

In some non-limiting embodiments, the indication (e.g., indication displayed on a display screen, other visual indication such as lights, the audible indication, and/or the like) may include a rate of closing distance (e.g., a closing speed). For example, the indication may include an alarm or warning (e.g., indication displayed on a display screen, other visual indication such as lights, the audible indication, and/or the like) when speed/rate of closing distance exceeds a threshold.

In some non-limiting embodiments, the indication (e.g., indication displayed on a display screen, other visual indication such as lights, the audible indication, and/or the like) may include an indication to stop and/or apply the brakes. For example, the indication may include an alarm or warning (e.g., indication displayed on a display screen, other visual indication such as lights, the audible indication, and/or the like) that is associated with stopping the train.

In some non-limiting embodiments, interface 120 may include and/or receive inputs from at least one input component 110. For example, the input component(s) 110 may include one or more input components for user input (e.g., a touch screen display, a keyboard, a keypad, a mouse, a button, a switch, a microphone, etc.), such as from an operator and/or crew member of a rail vehicle. For example, interface 120 may receive at least one control signal from and/or generate at least one control signal based on input from a user (e.g., operator) via input component(s) 110. In some non-limiting embodiments, interface 120 may include one or more additional input components/interfaces, such as safety and/or remote control systems (e.g., PTC or ETMS), other inputs (e.g., other sensors, other authorized triggers, and/or the like). For example, interface 120 may receive at least one control signal from and/or generate at least one control signal based on such input component(s) 110. Such control signals may control a speed of the rail vehicle, apply the brakes of the rail vehicle, and/or the like.

In some non-limiting embodiments, interface 120 may include a communication interface (e.g., wired or wireless communication interface). Additionally or alternatively, interface 130 may include a communication interface (e.g., wired or wireless communication interface). In some non-limiting embodiments, interface 120 may communicate with interface 130 via respective communication interfaces thereof. In some non-limiting embodiments, interface 120 (e.g., a communication interface of interface 120) may communicate directly with sensor(s) 140 (e.g., a communication interface of sensor(s) 140), image capture device 145 (e.g., a communication interface of image capture device 145), other components, devices, and/or systems of environment 100, and/or the like independent of interface 130.

In some non-limiting embodiments, sensor(s) 140 may be controlled by at least one controller (e.g., processor and/or the like) and/or sensor data from the sensors may be processed by at least one controller (e.g., processor and/or the like). For example, the controller(s) may be integrated with interface 130 (e.g., an EOT device, and/or the like). Additionally or alternatively, the controller(s) may be integrated with interface 120 (e.g., an HOT device, an operator interface, a PTC, an ETMS, and/or the like). Additionally or alternatively, the controller(s) may be at least partially separate from and independent of interface 120 and interface 130. In some non-limiting embodiments, the controller(s) may be integrated into sensor(s) 140. Additionally or alternatively, multiple controllers may be deployed simultaneously, e.g., at interface 120, interface 130, sensor(s) 140, and/or the like.

In some non-limiting embodiments, environment 100 may include image capture device 145. In some non-limiting embodiments, interface 120 may display an image and/or video captured by image capture device 145. For example, interface 120 may include a display screen, and the image and/or video captured by image capture device 145 may be displayed in at least a portion of the display screen. Additionally, the indications described herein (e.g., heading, distance, warning/alarms, and/or the like) may be displayed overlaid on the image and/or video captured by image capture device 145.

In some non-limiting embodiments, the velocity of the rail vehicle may be automatically controlled (e.g., by interface 120 of the rail vehicle, another control interface onboard the rail vehicle, a remote control interface such as a remoter server, a PTC, an ETMS, and/or the like) based on the sensor data from sensor(s) 140. For example, interface 120 (or another control interface onboard the rail vehicle, a remote control interface such as a remote server, and/or the like) may automatically reduce a speed of the rail vehicle, apply the brakes of the rail vehicle, and/or the like based on the sensor data. In some non-limiting embodiments, interface 120 (or another control interface onboard the rail vehicle, a remote control interface such as a remoter server, a PTC, an ETMS, and/or the like) may automatically reduce a speed of the rail vehicle, apply the brakes of the rail vehicle, and/or the like based on the distance between the rail vehicle (e.g., the rear car thereof) and an object in the track network is below a threshold or if a closing speed between the rail vehicle and such an object is above a threshold. In some non-limiting embodiments, interface 120 (or another control interface onboard the rail vehicle, a remote control interface such as a remoter server, a PTC, an ETMS, and/or the like) may automatically reduce a speed of the rail vehicle, apply the brakes of the rail vehicle, and/or the like based on a change in heading of at least a portion of the rail vehicle (e.g., the rear car thereof) and/or the like.

In some non-limiting embodiments, the sensors(s) 140 may sense continuously, iteratively, and/or the like (e.g., while the rail vehicle is moving, while the rail vehicle is moving in reverse, and/or the like). Additionally or alternatively, the indication(s) may be provided and/or updated continuously, iteratively, and/or the like based on the sensor data from the sensor(s) 140.

The number and arrangement of systems shown in FIG. 1 are provided as an example. There may be additional systems, devices, and/or networks, fewer systems, devices, and/or networks, different systems, devices, and/or networks, or differently arranged systems, devices, and/or networks than those shown in FIG. 1. Furthermore, two or more systems or devices shown in FIG. 1 may be implemented within a single system or a single device, or a single system or a single device shown in FIG. 1 may be implemented as multiple, distributed systems or devices. Additionally or alternatively, a set of systems or a set of devices (e.g., one or more systems, one or more devices) of environment 100 perform one or more functions described as being performed by another set of systems or another set of devices of environment 100.

Figure 2:
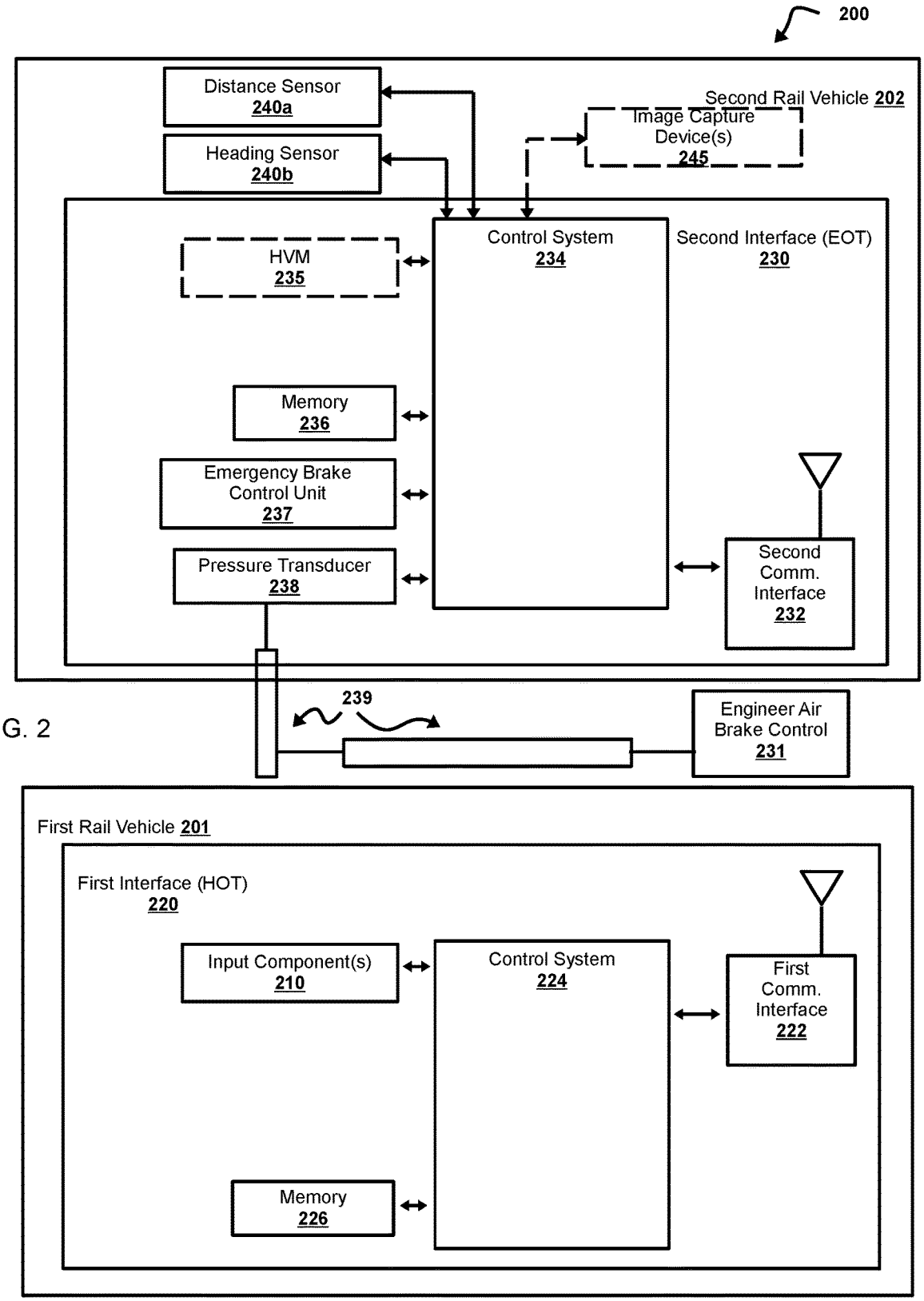
FIG. 2 is a diagram of a non-limiting embodiment of a rail vehicle system according to the principles of the presently disclosed subject matter.

Referring now to FIG. 2, FIG. 2 is a diagram of a non-limiting embodiment of a rail vehicle system 200 for controlling an indicator. As shown in FIG. 2, a first rail vehicle 201 (e.g., front car of a rail vehicle, such as a locomotive or control car) may include first interface 220 (e.g., HOT, PTC, ETMS, operator interface, and/or the like). In some non-limiting embodiments, first interface 220 may be the same as, or similar to, interface 120. First interface 220 may include at least one input component 210 (e.g., operator input, PTC input, ETMS input, sensor input, other authorized triggers, and/or the like), and/or the like. In some non-limiting embodiments, input component(s) 210 may be the same as, or similar to, input component(s) 110. Additionally or alternatively, interface 220 may include memory 226 and control system 224. In some non-limiting embodiments, control system 224 and/or memory 226 may be the same as, or similar to, at least part of a controller associated with sensor(s) 240*a*, 240*b*, as described herein. In some non-limiting embodiments, first interface 220 may further include first communication interface 222 (e.g., a wired or wireless transceiver). In some non-limiting embodiments, first communication interface 222 may be the same as, or similar to, the communication interface of interface 120.

As further shown in FIG. 2, a second rail vehicle 202 (e.g., rear car of a rail vehicle) may include second interface 230 (e.g., EOT device and/or the like). In some non-limiting embodiments, second interface 230 may be the same as or similar to interface 130. In some non-limiting embodiments, second interface 230 (e.g., EOT device and/or the like) may include at least one sensor such as distance sensor 240*a* and/or heading sensor 240*b*. In some non-limiting embodiments, distance sensor 240*a* and/or heading sensor 240*b* may be the same as, or similar to, sensor(s) 140. Additionally or alternatively, distance sensor 240*a* and/or heading sensor 240*b* may be coupled to, in communication with, and/or removably connected to second interface 230 (e.g., EOT device and/or the like). In some non-limiting embodiments, second interface 230 (e.g., EOT device and/or the like) may include HVM 235. For example, HVM 235 may be the same as or similar to HVM 135. In some non-limiting embodiments, second rail vehicle 202 may include image capture device 245. In some non-limiting embodiments, image capture device 245 may be the same as or similar to image capture device 145 and/or sensor(s) 140.

Additionally or alternatively, interface 220 may include memory 236 and control system 234. In some non-limiting embodiments, control system 234 and/or memory 236 may be the same as, or similar to, at least part of a controller associated with sensors 240*a* and/or 240*b*, as described herein. In some non-limiting embodiments, second interface 230 may further include second communication interface 232 (e.g., a wired or wireless transceiver). In some non-limiting embodiments, second communication interface 232 may be the same as or similar to the communication interface of interface 130.

In some non-limiting embodiments, second interface 230 may be mounted on a trailing coupler of the last rail vehicle in a rail vehicle system (e.g., a plurality of rail vehicles connected together, a train, a train of cars, etc.) and second interface 230 may be equipped with at least one device (e.g., a transducer, an additional sensor, and/or the like) for monitoring the pressure of a brake system of the rail vehicle system and/or a telemetry device. For example, second interface 230 may include pressure transducer 238 that is connected to air brake coupling 239 and control system 234.

In some non-limiting embodiments, control system 234 and/or control system 224 may receive telemetry information (e.g., position information, GPS position information, etc.). For example, such telemetry information may be received via input component(s) 210 (e.g., PTC device, ETMS device, additional sensors, other authorized triggers, and/or the like). Additionally or alternatively, such telemetry information may be associated with a rail vehicle (e.g., a train). In some non-limiting embodiments, control system 234 and/or control system 224 may affect the operation of the rail vehicle based on the telemetry information. For example, control system 234 and/or control system 224 may cause a brake system of the rail vehicle to be activated based on the telemetry information. Additionally or alternatively, control system 234 and/or control system 224 may affect the operation of the rail vehicle based on sensor data from distance sensor 240*a* and/or heading sensor 240*b*, as described herein.

In some non-limiting embodiments, air brake coupling 239 may mechanically couple a rail vehicle that includes first interface 220 to second interface 230. In some non-limiting embodiments, air brake coupling 239 may be used by first interface 220 and/or second interface 230 to verify (e.g., based on a physical connection) that first interface 220 and/or second interface 230 is properly linked for communication between first interface 220 and/or second interface 230. In some non-limiting embodiments, an operator (e.g., a locomotive engineer) may control the air brakes of a rail vehicle (e.g., a rail vehicle of a rail vehicle system, such as a train) via engineer air brake control 231 and air brake coupling 239, which may extend the length of a rail vehicle system. In some non-limiting embodiments, control system 234 may control the air brakes of a rail vehicle in an emergency situation via emergency brake control unit 237. For example, an emergency situation may be based on an indication (e.g., warning or alarm) that is based on sensor data from distance sensor 240*a* and/or heading sensor 240*b*, as described herein.

In some non-limiting embodiments, second interface 230 may communicate with (e.g., send information to and receive information from) first interface 220 and vice versa via a communication link (e.g., a short range communication link) between first communication interface 222 (e.g., first transceiver) and second communication interface 232 (e.g., second transceiver). For example, second interface 230 may communicate position information relating to a position of a rail vehicle (e.g., position information relating to a position of rail vehicle 202 derived from a Global Positioning System (GPS) receiver of rail vehicle 202) to first interface 220 via the communication link between first communication interface 222 (e.g., first transceiver) and second communication interface 232 (e.g., second transceiver). In some non-limiting embodiments, the communication link may operate with a bandwidth of 450 Mhz. The way in which second interface 230 may communicate with first interface 220 and vice versa, as well as control systems described above, are described in more detail in U.S. patent application Ser. No. 07/313,877, filed Feb. 23, 1989, which is assigned to the same assignee as this application and is incorporated herein by reference.

In some non-limiting embodiments, control system 234 and/or control system 224 may receive sensor data associated with sensors such as distance sensor 240*a* and/or heading sensor 240*b*, as described herein. For example, at least one of distance sensor 240*a* and/or heading sensor 240*b* may generate sensor data, as described herein. Additionally or alternatively, control system 234 may receive the sensor data associated with at least one of distance sensor 240*a* and/or heading sensor 240*b*, as described herein. Additionally or alternatively, control system 234 may generate sensor data based on digital and/or analog signals received from at least one of distance sensor 240*a* and/or heading sensor 240*b* may generate sensor data, as described herein. In some non-limiting embodiments, control system 234 may communicate the sensor data via second communication interface 232 to first communication interface 222. Additionally or alternatively, second communication interface 222 and/or control system 224 may receive the sensor data directly from sensor(s) 240. In some non-limiting embodiments, the sensor data may be generated based on at least one of a heading of rail vehicle 202 (e.g., sensed by heading sensor 240*b*) and/or a distance between rail vehicle 202 and an object in the track network (e.g., sensed by distance sensor 240*a*), as described herein.

In some non-limiting embodiments, control system 224 and/or control system 234 may provide an indication based on the sensor data, as described herein. For example, control system 224 may receive the sensor data via the first communication interface 222 coupled thereto. Additionally or alternatively, control system 224 may provide a visual and/or audible indication based on the sensor data, as described herein.

Figure 3:
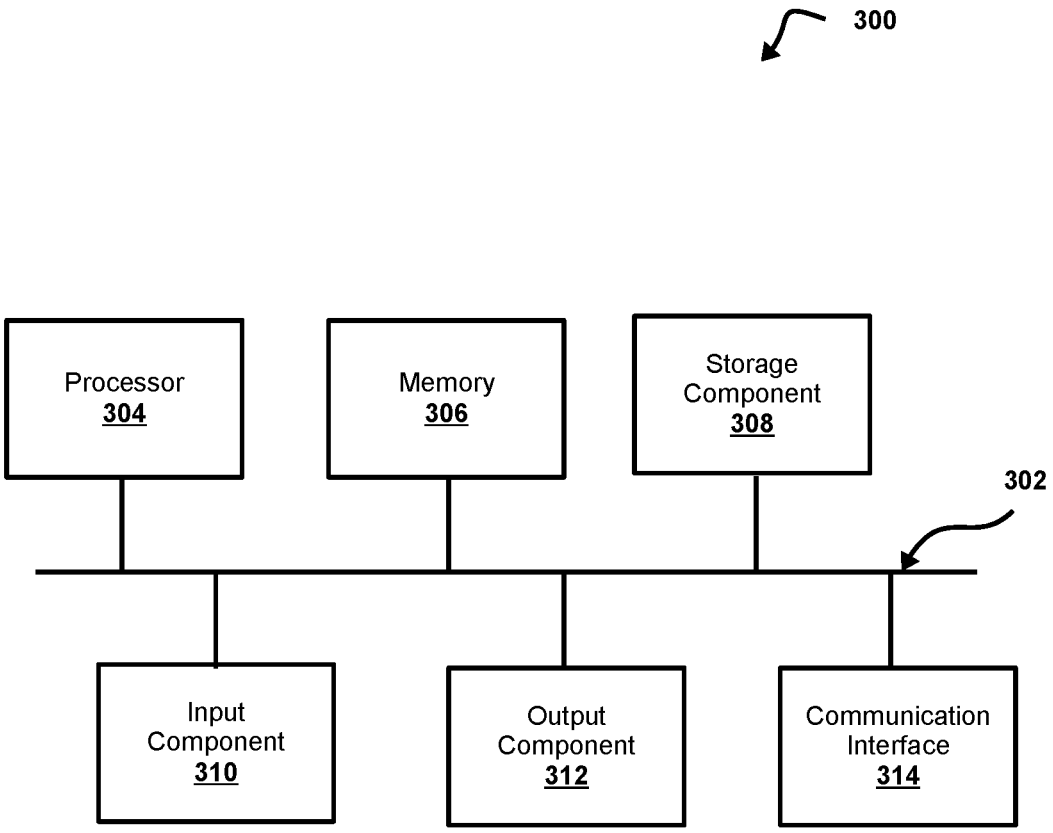
FIG. 3 is a diagram of a non-limiting embodiment of components of one or more devices of FIG. 1 and FIG. 2 according to the principles of the presently disclosed subject matter.

Referring now to FIG. 3, FIG. 3 is a diagram of example components of a device 300. Device 300 corresponds to one or more devices of environment 100 (e.g., input component (s) 110, interface 120, interface 130, HVM 135, sensor(s) 140, and/or image capture device 145) and/or one or more devices of system 200 (e.g., first interface 220, input component(s) 210, control system 224, memory 226, first communication interface 222, second interface 230, control system 234, memory 236, emergency brake control unit 237, pressure transducer 238, air brake coupling 239, engineer air brake control 231, HVM 235, distance sensor 240*a*, heading sensor 240*b*, image capture device 245, and/or second communication interface 232). In some non-limiting embodiments, one or more devices of environment 100 and/or system 200 may include at least one device 300 and/or at least one component of device 300. As shown in FIG. 3, device 300 may include bus 302, processor 304, memory 306, storage component 308, input component 310, output component 312, and communication interface 314.

Bus 302 may include a component that permits communication among the components of device 300. In some non-limiting embodiments, processor 304 may be implemented in hardware, firmware, software, or any combination thereof. For example, processor 304 may include a processor (e.g., a central processing unit (CPU), a graphics processing unit (GPU), an accelerated processing unit (APU), etc.), a microprocessor, a digital signal processor (DSP), and/or any processing component (e.g., a field-programmable gate array (FPGA), an application-specific integrated circuit (ASIC), etc.) that can be programmed to perform a function. Memory 306 may include a random access memory (RAM), a read-only memory (ROM), and/or another type of dynamic or static storage device (e.g., flash memory, magnetic memory, optical memory, etc.) that stores information and/or instructions for use by processor 304.

Storage component 308 may store information and/or software related to the operation and use of device 300. For example, storage component 308 may include a hard disk (e.g., a magnetic disk, an optical disk, a magneto-optic disk, a solid state disk, etc.), a flash memory, a compact disc (CD), a digital versatile disc (DVD), a floppy disk, a cartridge, a magnetic tape, and/or another type of computer-readable medium, along with a corresponding drive.

Input component 310 may include a component that permits device 300 to receive information, such as via user input (e.g., a touch screen display, a keyboard, a keypad, a mouse, a button, a switch, a microphone, etc.). Additionally or alternatively, input component 310 may include a sensor for sensing information (e.g., a GPS component, an accelerometer, a gyroscope, an actuator, a light sensor, a barometer, a thermometer, a speed sensor (e.g., speedometer), a clock, a distance sensor, radar, LIDAR, ultrasonic ranging, a camera, a set of multi-view/three-dimensional cameras, an accelerometer, a magnetometer, a compass, and/or the like). Output component 312 may include a component that provides output information from device 300 (e.g., a display, one or more lights, one or more light-emitting diodes (LEDs), a speaker, a bell, a chime, a whistle, etc.).

Communication interface 314 includes a transceiver-like component (e.g., a transceiver, a separate receiver and transmitter, etc.) that enables device 300 to communicate with other devices, such as via a wired connection, a wireless connection, or a combination of wired and wireless connections. Communication interface 314 permits device 300 to receive information from another device and/or provide information to another device. For example, communication interface 314 may include an Ethernet interface, an optical interface, a coaxial interface, an infrared interface, a radio frequency (RF) interface, a universal serial bus (USB) interface, a Wi-Fi interface, a cellular network interface, and/or the like.

In some non-limiting embodiments, device 300 performs one or more processes described herein. In some non-limiting embodiments, device 300 performs these processes based on processor 304 executing software instructions stored by a computer-readable medium, such as memory 306 and/or storage component 308. A computer-readable medium (e.g., a non-transitory computer-readable medium) is defined herein as a non-transitory memory device. A memory device includes memory space located inside of a single physical storage device or memory space spread across multiple physical storage devices.

Software instructions are read into memory 306 and/or storage component 308 from another computer-readable medium or from another device via communication interface 314. When executed, software instructions stored in memory 306 and/or storage component 308 cause processor 304 to perform one or more processes described herein. Additionally or alternatively, hardwired circuitry may be used in place of or in combination with software instructions to perform one or more processes described herein. Thus, embodiments described herein are not limited to any specific combination of hardware circuitry and software.

The number and arrangement of components shown in FIG. 3 are provided as an example. In some non-limiting embodiments, device 300 includes additional components, fewer components, different components, or differently arranged components than those shown in FIG. 3. Additionally or alternatively, a set of components (e.g., one or more components) of device 300 performs one or more functions described as being performed by another set of components of device 300.

Figure 4:
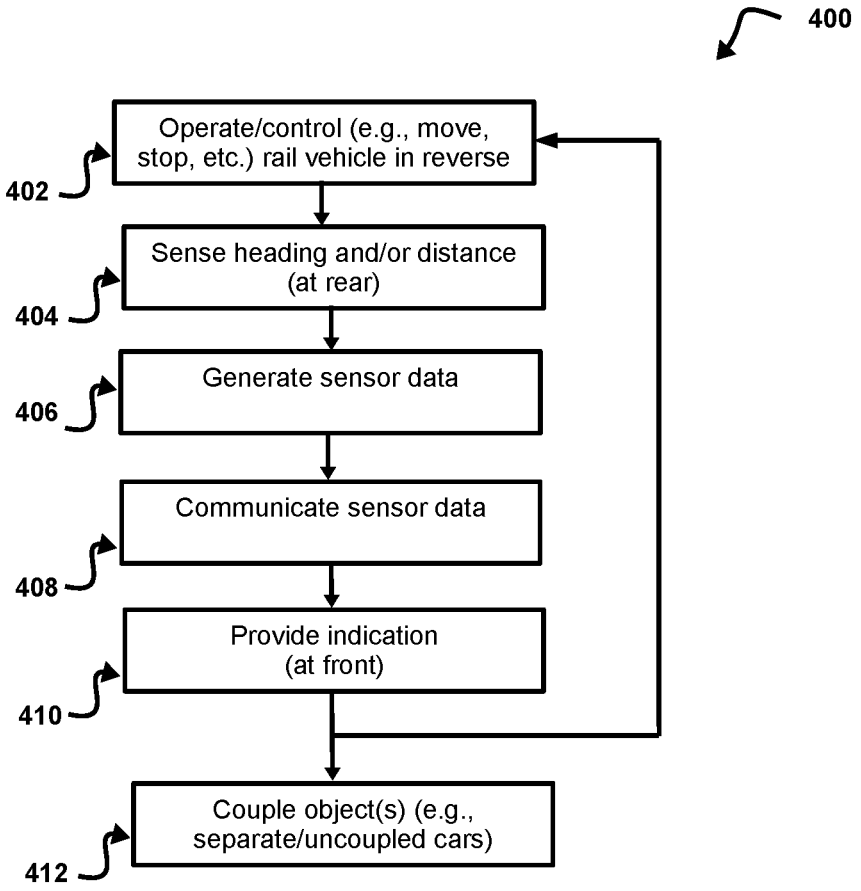
FIG. 4 is a flowchart of a non-limiting embodiment of a process for sensing and indicating motion of a rear car of a rail vehicle according to the principles of the presently disclosed subject matter.

Referring now to FIG. 4, FIG. 4 is a flowchart of a non-limiting embodiment of a process 400 for sensing and indicating motion of a rear car of a rail vehicle. In some non-limiting embodiments, one or more of the steps of process 400 may be performed (e.g., completely, partially, etc.) by interface 130 and/or second interface 230 (e.g., one or more components or devices of interface 130 and/or second interface 230). In some non-limiting embodiments, one or more of the steps of process 400 may be performed (e.g., completely, partially, etc.) by another device or a group of devices separate from or including interface 130 and/or second interface 230, such as interface 120 and/or first interface 220 (e.g., one or more components or devices of interface 120 and/or first interface 220); sensor(s) 140, distance sensor 240*a*, and/or heading sensor 240*b*; one or more components or devices of environment 100; one or more components or devices of system 200; and/or the like.

As shown in FIG. 4, at step 402, process 400 may include operating (e.g., controlling, driving, braking, slowing, stopping, and/or the like) a rail vehicle in reverse. For example, an operator, a control system (e.g., an operator interface, an HOT device, a PTC, an ETMS, a remote control system/server, interface 120, first interface 220, and/or the like), and/or the like may control the rail vehicle (e.g., first rail vehicle 201, second rail vehicle 202, and/or the like) to operate in reverse. In some non-limiting embodiments, the rail vehicle may be operating in reverse towards an object (e.g., at least one separate rail car, and/or the like) in the track network, a switch (e.g., siding switch) between tracks in the track network, and/or the like, as described herein.

As shown in FIG. 4, at step 404, process 400 may include sensing a heading of at least a portion of the rail vehicle (e.g., a rear car of the rail vehicle), a distance between the rail vehicle (e.g., the rear car of the rail vehicle), an object in the track network, and/or the like. For example, at least one sensor (e.g., sensor(s) 140, distance sensor 240*a*, heading sensor 240*b*, and/or the like) may sense such a heading, such a distance, and/or the like, as described herein.

As shown in FIG. 4, at step 406, process 400 may include generating sensor data. In some non-limiting embodiments, the sensor(s) (e.g., sensor(s) 140, distance sensor 240*a*, heading sensor 240*b*, and/or the like) may generate sensor data associated with the property being sensed, as described herein. For example, a distance sensor (e.g., sensor(s) 140, distance sensor 240*a*, and/or the like) may generate sensor data (e.g., distance data) associated with the distance between the rail vehicle (e.g., the rear car with which the distance sensor is disposed) and an object in the track network. Additionally or alternatively, a heading sensor (e.g., sensor(s) 140, heading sensor 240*b*, and/or the like) may generate sensor data (e.g., heading data) associated with the heading of the rail vehicle (e.g., the heading of the rear car with which the heading sensor is disposed).

In some non-limiting embodiments, a controller (e.g., interface 120, interface 130, control system 224, control system 234, and/or the like) may generate sensor data based on at least one of a digital signal, an analog signal, and/or the like from the sensor(s) (e.g., sensor(s) 140, distance sensor 240*a*, heading sensor 240*b*, and/or the like), as described herein.

As shown in FIG. 4, at step 408, process 400 may include communicating the sensor data. For example, the sensor(s) (e.g., sensor(s) 140, distance sensor 240*a*, heading sensor 240*b*, and/or the like), a controller (e.g., interface 130, control system 234, an EOT device, and/or the like) coupled to the sensor(s), a communication interface (e.g., interface 130, second communication interface 232, EOT device, and/or the like) and/or the like may communicate (e.g., transmit and/or the like) the sensor data, as described herein. Additionally or alternatively, a receiver (e.g., an operator interface, a remote control system/server, an HOT device, a PTC, an ETMS, interface 120, first interface 220, and/or the like) may receive the sensor data, as described herein.

In some non-limiting embodiments, the receiver (e.g., an operator interface, an HOT device, a PTC, an ETMS, interface 120, first interface 220, and/or the like) may be disposed at or near a front of the rail vehicle (e.g., onboard the lead locomotive or control car, first rail vehicle 201, and/or the like), as described herein. Additionally or alternatively, the sensor(s) (e.g., sensor(s) 140, distance sensor 240*a*, heading sensor 240*b*, and/or the like), a controller (e.g., interface 130, control system 234, an EOT device, and/or the like) coupled to the sensor(s), a communication interface (e.g., interface 130, second communication interface 232, EOT device, and/or the like) and/or the like may be disposed at or near a rear of the rail vehicle (e.g., a rear car, second rail vehicle 202, and/or the like), as described herein.

As shown in FIG. 4, at step 410, process 400 may include providing at least one indication based on the sensor data. For example, a receiver of the sensor data (e.g., an operator interface, a remote control system/server, an HOT device, a PTC, an ETMS, interface 120, first interface 220, and/or the like) may provide an indication (e.g., display an indication, provide a visual indication, provide and audible indication, and/or the like) based on the sensor data, as described herein.

In some non-limiting embodiments, the receiver of the sensor data (e.g., an operator interface, an HOT device, a PTC, an ETMS, interface 120, first interface 220, and/or the like) may be disposed at or near a front of the rail vehicle (e.g., onboard the lead locomotive or control car, first rail vehicle 201, and/or the like), as described herein. Additionally or alternatively, such a receiver may provide the indication(s) at or near the front of the rail vehicle (e.g., perceptible by an operator of the rail vehicle and/or the like), as described herein.

In some non-limiting embodiments, the receiver (e.g., operator interface, HOT device, PTC, ETMS, interface 120, first interface 220, and/or the like) may include a display screen, and providing the indication may include displaying a visual (e.g., numerical, graphical, and/or the like) indication based on the sensor data, as described herein.

As shown in FIG. 4, process 400 and/or a portion thereof may repeat, continue iteratively, continue continuously, and/or the like. For example, after step 410, process 400 may return to step 402. In some non-limiting embodiments, as shown in FIG. 4, at step 402, process 400 may include controlling (e.g., automatically controlling and/or the like) the rail vehicle based on the indication. For example, an operator, a control system (e.g., an operator interface, an HOT device, a PTC, an ETMS, a remote control system/server, interface 120, first interface 220, and/or the like), and/or the like may control (e.g., drive, brake, change velocity, slow, stop, and/or the like) the rail vehicle (e.g., first rail vehicle 201, second rail vehicle 202, and/or the like) based on the indication/sensor data, as described herein. For example, the rail vehicle may be slowed (e.g., reduce speed, apply brakes, and/or the like) or stopped based on distance data from a distance sensor (e.g., sensor(s) 140, distance sensor 240*a*, and/or the like) indicating a distance to an object in the track network is below a threshold, a closing speed exceeds a threshold, and/or the like, as described herein. Additionally or alternatively, the rail vehicle may be controlled (e.g., change speed, apply brakes, and/or the like) based on an indication that a heading of at least a portion of the rail vehicle (e.g., a rear car, second rail vehicle 202, and/or the like) has suddenly changed heading based on heading data from a heading sensor (e.g., sensor(s) 140, heading sensor 240*b*, and/or the like), as described herein.

As shown in FIG. 4, at step 412, process 400 may include coupling the object (e.g., at least one separate rail vehicle/rail car and/or the like) in the track network to the rail vehicle. For example, an operator, a crew member, and/or the like may be positioned at and/or move to the rear of the rail vehicle after the rail vehicle is stopped near the object (e.g., at least one separate rail vehicle/rail car and/or the like) in the track network. Additionally or alternatively, any necessary and/or desired connection equipment (e.g., air hoses, electrical connections, and/or the like) may be connected between the rail vehicle and the object. Additionally or alternatively, an EOT device may be removed from the trailing coupler of the rail vehicle and/or attached to a trailing coupler of the object. Additionally or alternatively, a lead coupler of the object may be attached to the trailing coupler of the rail vehicle.

In some non-limiting embodiments, the disclosed subject matter may allow an operator (e.g., train driver, locomotive engineer, and/or the like) to received feedback (e.g., sensor data, indications associated therewith, and/or the like) regarding closing distance/speed while backing up (e.g., operating in reverse) to at least one separate rail vehicle (e.g., a cut of rail cars and/or the like). Additionally or alternatively, based on the feedback, an operator (e.g., driver, engineer, and/or the like) may better manage speed/velocity of the rail vehicle before/during a time of coupling the rail vehicle to the separate rail vehicle (e.g., cut of cars and/or the like). Additionally or alternatively, the disclosed subject matter may obviate (e.g., eliminate and/or the like) a need for a second person (e.g., crew member and/or the like) before/during the coupling process (e.g., such a second person's duty may otherwise be to provide verbal indications of closing distance/speed to the operator).

In some non-limiting embodiments, the disclosed subject matter may employ an EOT device and/or HOT device. For example, the EOT device may include some similar functions to existing EOT devices and additionally include sensor(s) (e.g., distance sensor such as radar and/or the like and/or heading sensor such as a compass and/or the like). For example, an indication of heading of a last car of a rail vehicle may be beneficial/useful to show that the rear car has moved from a first track (e.g., the main track and/or the like) of a track network to a second track (e.g., a turnout and/or the like). For example, such information may be beneficial when the point of coupling (e.g., the location of the separate rail cars and/or the like) is at or near the switch (e.g., siding switch) between tracks (e.g., when a distance sensor may be challenged and/or fail to detect the separate car(s) because the first track/rear car may not be pointing directly at the separate car(s) to be coupled).

In some non-limiting embodiments, the device for providing the indication based on sensor data (e.g., HOT device) may be a stand-alone unit. Additionally or alternatively, such a device may be integrated (e.g., completely, partially, and/or the like) with some other devices and/or displays in the operator compartment (e.g., PTC, ETMS, and/or the like). Additionally or alternatively, indication(s) (e.g., information related to sensor data and/or the like) may be provided (e.g., displayed and/or the like) to the operator (e.g., driver, engineer, and/or the like). For example, information associated with a closing distance, a closing speed, a heading of the last car of the rail vehicle, and/or the like may be provided (e.g., displayed). In some non-limiting embodiments, an audible indication/alert may also be provided based on the sensor data (e.g., upon reaching a threshold associated with closing distance, closing time, closing speed, and/or the like). Additionally or alternatively, a separate audible indication/alert may be generated based on the heading of the last car of the rail vehicle making a change that exceeds a threshold (e.g., representing transition from first/main track onto a switch/second track).

In some non-limiting embodiments, an individual (e.g., the operator, another crew member, and/or the like) may move to the coupling point to make desired connections (e.g., air hoses, electrical connections, and/or the like), move the EOT device from the trailing end of the separate car(s) to be coupled to the rail vehicle, attached to the couplers of the rail vehicle and separate car(s), and/or the like. In some non-limiting embodiments, the disclosed subject matter may advantageously allow a single person (e.g., the operator) to operate the rail vehicle in reverse and couple the separate cars (e.g., without a second person/crew member).

The foregoing disclosure provides illustration and description, but is not intended to be exhaustive or to limit the implementations to the precise form disclosed. Modifications and variations are possible in light of the above disclosure or may be acquired from practice of the implementations.

It will be apparent that systems and/or methods, described herein, may be implemented in different forms of hardware, firmware, software, or any combination thereof. The actual specialized control hardware or software code used to implement these systems and/or methods is not limiting of the implementations. Thus, the operation and behavior of the systems and/or methods were described herein without reference to specific software code—it being understood that software and hardware can be designed to implement the systems and/or methods based on the description herein.

Even though particular combinations of features are recited in the claims and/or disclosed in the specification, these combinations are not intended to limit the disclosure of possible implementations. In fact, many of these features may be combined in ways not specifically recited in the claims and/or disclosed in the specification. Although each dependent claim listed below may directly depend on only one claim, the disclosure of possible implementations includes each dependent claim in combination with every other claim in the claim set.

What is claimed is:

1. A device comprising:

at least one sensor configured to be disposed onboard a first vehicle, the at least one sensor configured to generate sensor data associated with at least one of a heading of the first vehicle or a distance between the first vehicle and an object in a track network; and a communication interface configured to transmit the sensor data to at least one receiver onboard a second vehicle that provides at least one indication based on the sensor data.

2. The device of claim 1, wherein the at least one sensor and the communication interface are configured to be disposed onboard the first vehicle.

3. The device of claim 2, wherein the at least one sensor and the communication interface are configured to be integrated with an end of train (EOT) device coupled to a trailing coupler of the first vehicle.

4. The device of claim 2, wherein the at least one sensor is removably connected to an end of train (EOT) device.

5. The device of claim 1, wherein the communication interface is configured to transmit the sensor data to the at least one receiver that includes an operator interface onboard the second vehicle.

6. The device of claim 5, wherein the operator interface is configured to be integrated with at least one of a head of train (HOT) device, a positive train control (PTC) system, or an electronic train management system (ETMS).

7. The device of claim 1, wherein the communication interface is configured to transmit the sensor data to the at least one receiver that is a remote server.

8. The device of claim 1, wherein the at least one sensor comprises a first sensor configured to sense the heading of the first vehicle and a second sensor to sense the distance between the first vehicle and the object in the track network.

9. The device of claim 1, wherein the communication interface is configured to transmit the sensor data to the at least one receiver that provides at least one of an audible indication or a visual indication as the at least one indication.

10. The device of claim 1, further comprising the at least one receiver, the at least one receiver configured to automatically control a velocity of the at least the first vehicle or the second vehicle based on the sensor data.

11. A control system comprising:

a device configured to be attached to a first vehicle, the device comprising:

at least one sensor configured to be disposed onboard the first vehicle, the at least one sensor configured to generate sensor data associated with at least one of a heading of the first vehicle or a distance between the first vehicle and an object in a track network; and a communication interface configured to transmit the sensor data; and an operator interface onboard a second vehicle or control car and configured to receive sensor data from the communication interface, wherein the operator interface is configured to provide at least one indication based on the sensor data.

12. The system of claim 11, wherein the communication interface is configured to be integrated with an end of train (EOT) device coupled to a trailing coupler of the first vehicle, and wherein the at least one sensor is removably connected to the EOT device.

13. The system of claim 11, wherein the operator interface is configured to be integrated with at least one of a head of train (HOT) device, a positive train control (PTC) system, or an electronic train management system (ETMS).

14. The system of claim 11, further comprising a remote server configured to receive at least one of the sensor data from the communication interface or the at least one indication from the operator interface.

15. The system of claim 11, wherein the operator interface is configured to automatically control a velocity of the at least one of the first vehicle or the second vehicle based on the sensor data.

16. A method comprising:

sensing, with at least one sensor disposed onboard a first vehicle, at least one of a heading of the first vehicle or a distance between the first vehicle and an object in a track network;

generating sensor data based on at least one of the heading of the first vehicle and the distance between the first vehicle and the object in the track network;

communicating the sensor data; and providing at least one indication based on the sensor data.

17. The method of claim 16, wherein the sensor data is communicated to an operator interface onboard a second vehicle and the at least one indication based on the sensor data is provided by the operator interface.

18. The method of claim 17, wherein the operator interface is configured to be integrated with at least one of a head of train (HOT) device, a positive train control (PTC) system, or an electronic train management system (ETMS), wherein the operator interface comprises a display screen, and wherein providing the at least one indication comprises displaying at least one visual indication on the display screen.

19. The method of claim 16, further comprising automatically controlling a velocity of the first vehicle based on the sensor data.

20. The method of claim 16, wherein the object in the track network comprises a separate car, the method further comprising:

moving the first vehicle towards the separate car in the track network; and repeating the sensing, generating, communicating, and providing as the first vehicle moves towards the separate car in the track network.

* * * * *